US006792635B2

(12) United States Patent
Yen

(10) Patent No.: US 6,792,635 B2
(45) Date of Patent: Sep. 21, 2004

(54) TYPE OF JOINING PLIERS

(76) Inventor: Chao-Chin Yen, No. 15, Lane 21, Yen Ho Rd., Tu Cheng City, Taipei Hsien (TW)

( * ) Notice: Subject to any disclaimer, the term of this patent is extended or adjusted under 35 U.S.C. 154(b) by 40 days.

(21) Appl. No.: 10/171,661

(22) Filed: Jun. 17, 2002

(65) Prior Publication Data

US 2003/0229944 A1 Dec. 18, 2003

(51) Int. Cl.[7] ..... B25F 1/00

(52) U.S. Cl. ..... 7/107; 29/751; 140/106; 72/409.08; 72/409.14; 81/421

(58) Field of Search ..... 7/107; 29/751; 140/105, 106; 81/421–423; 72/409.01, 409.06, 409.08, 409.11, 409.14, 409.16

(56) References Cited

U.S. PATENT DOCUMENTS 1,314,641 A * 9/1919 Fried ..... 72/409.08
3,710,610 A * 1/1973 McCaughey ..... 72/409.06
4,576,067 A * 3/1986 Buck ..... 81/185.1
4,862,580 A * 9/1989 Wang et al. ..... 29/566.4
6,230,387 B1 * 5/2001 Gritters et al. ..... 29/751
6,272,738 B1 * 8/2001 Holliday et al. ..... 29/751
6,473,925 B1 * 11/2002 Konen ..... 7/107
2003/0066136 A1 * 4/2003 Lu ..... 7/107

* cited by examiner

*Primary Examiner*—Debra Meislin
(74) *Attorney, Agent, or Firm*—Rosenberg, Klein & Lee

(57) ABSTRACT

An improved type of joining pliers, particularly one that presses and joins an object (coating terminal) to a conductive wire and can make correction without being deviated or displaced during a compressing and joining process, comprising a left handle, a right handle that is pivoted to the left handle so the two handles can be opened or folded to each other, an opening mold that is movably pivoted to the left handle, and a slide block that is movably pivoted to the right handle and can be embedded in the opening mold; by the mobility of the opening mold and the slide block that are movably pivoted to each other, the assembling position of the mobile opening mold and the slide block can be automatically corrected when the left and right handles are folded.

4 Claims, 7 Drawing Sheets

TYPE OF JOINING PLIERS

BACKGROUND OF THE INVENTION

1. Field of the Invention

The invention relates to an improved type of joining pliers, particularly to a type of pliers in which the moving line of the opening mold and the slide block can be corrected to become a straight line without the occurrence of deviation.

2. Description of the Prior Art

Please refer to FIGS. 1 and 2 that illustrate a conventional type of joining pliers, which can be used to coat terminals onto conductive wires, said joining pliers comprising a left handle 1 and a right handle 2, the top ends of the left and right handles 1, 2 are pivoted and overlapped to have protrusions 11, 21 that are movably pivoted by a joining member 14, at the joining member 14 and between the left and right handles 1, 2 is installed a torsion spring 24, the joining member 14 serving as an axis to fold the left and right handles 1, 2; and, on neighboring inner sides of the left and right handles 1, 2 are fitted a left and right cutting blades 12, 22 and an opening mold 13, a block unit 23, when in use, the left and right handles 1, 2 are folded, so the opening mold 13 and the block unit 23 can be pivoted together, and the coating terminal is compressed by the opening mold 13 and the block unit 23, thereby the terminal is pressed and pivoted to the conductive wire, to achieve the purpose of fixing the coated terminal onto the conductive wire.

However, the opening mold 13 and the block unit 23 of the conventional joining pliers are respectively fixed by screws onto the left and right handles 1, 2, and when the left and right handles 1, 2 are folded, the moving line of the opening mold 13 and the block unit 23 is arched, instead of a straight line that is easy for assembly, because the arched movement causes deviation and dislocation causing oblique compressing effect or failure of being compressed, even defects on the coated terminal that is compressed, resulting either in failure of complete joining purpose or poor electrical connection of the conductive wire.

Since the opening mold 13 and block unit 23 of the conventional joining pliers are of fixed type, when other terminals are to be joined to the conductive wire (such as telephone connector or network connector), the whole joining pliers must be replaced, in other words, you must purchase every pair of joining pliers for every terminals, which would cause much waste.

Therefore, to seek possible improvement on the shortcomings the conventional joining pliers, the inventor has devoted in the research and finally has come up with a reasonably designed invention with effective improvement on the above shortcomings.

SUMMARY OF THE INVENTION

The primary objective of the invention is to effectively avoid deviation during pressing and joining process, and defects on the joined objects (coated terminal) in the compressing and joining process.

The second objective of the invention is to enable free replacement of the components that are used to compress and join the objects to be pivoted.

To achieve the above objectives, the present invention provides an improved type of joining pliers, comprising a left handle, a right handle that is movably pivoted to the left handle so the two handles can open or fold to each other, an opening mold that is movably pivoted to the left handle, and a slide block that is movably pivoted to the right handle and can be inserted in the opening mold; by the mobility of the opening mold and the slide block, the assembly position of the mobile opening mold and the slide block can be automatically corrected when the left and right handles are folded.

For better understanding of the characteristics and technical contents of the present invention, please refer to the following description and drawings.

DETAILED DESCRIPTION OF PREFERRED EMBODIMENTS

Figure 3:
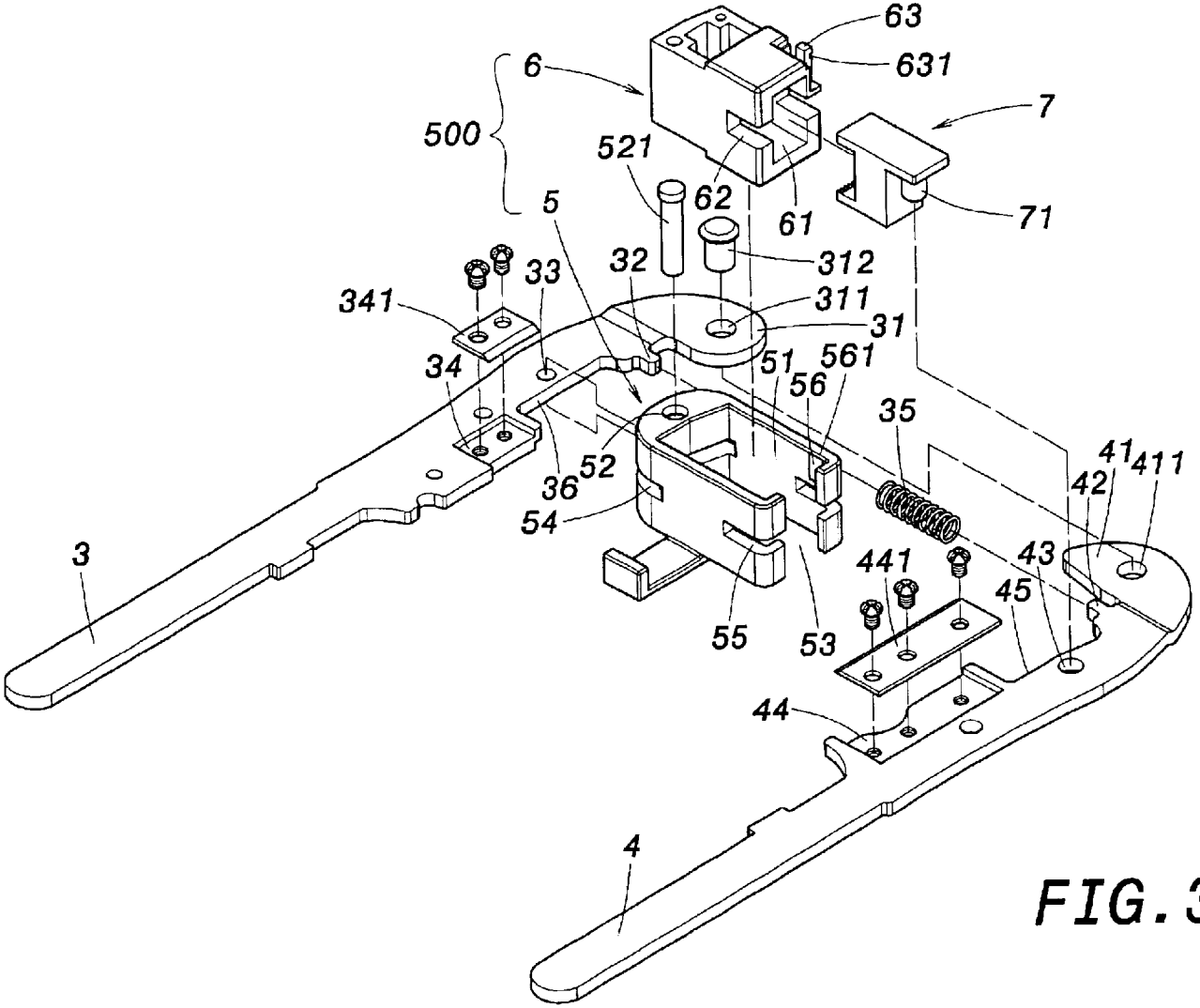
FIG. 3 is an exploded view of the invention.
Figure 4:
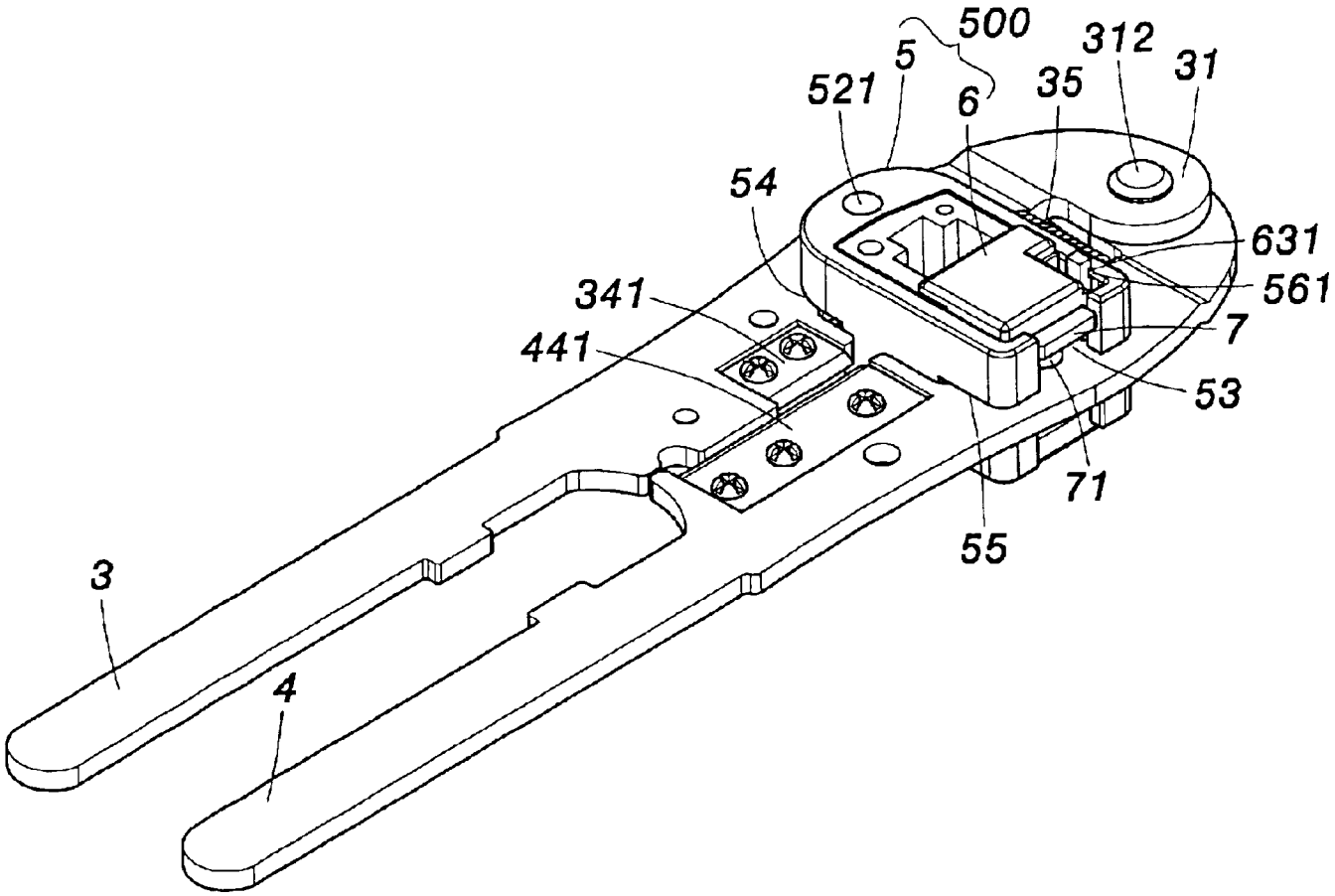
FIG. 4 is a perspective, assembled view of FIG. 3.
Figure 5:
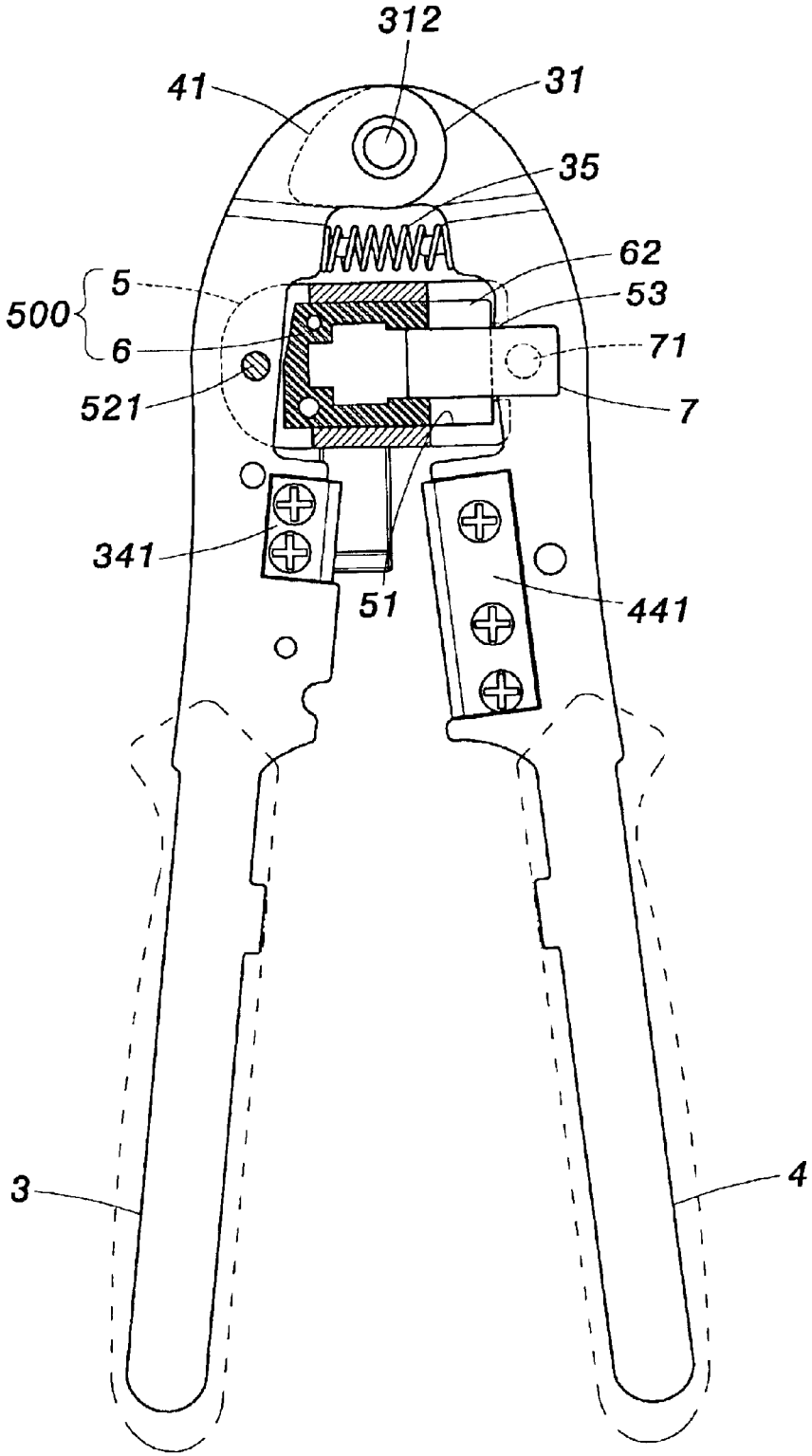
FIG. 5 is a plan view of the assembled invention, before operation.

As shown in FIGS. 3, 4 and 5, the present invention provides an improved type of joining pliers, comprising a left handle 3, a right handle 4, an opening mold 500 consisting of a mold unit 5 and a mold body 6, and a slide block 7.

On the top there are a left handle 3 and a right handle 4 that respectively has a protrusion 31, 41, the protrusions being overlapped and pivoted by a joining member 312 to form a figure that can open or close; at neighboring sides of the left and right handles 3, 4 is a pair of opposing protruding posts 32, 42, between the two protruding posts 32 42 is fitted a flexible member 35, serving as a fulcrum on which the joining pliers open or close; the left and right handles 3, 4 respectively has an embedding groove 34, 44, inside the embedding grooves 3, 4 are respectively embedded and screwed a left and right cutting blades 341, 441 (or line moving knife); between the protruding post (32 or 42) or the cutting blade (341 or 441) of the left and right handles is a joining hole 33, 43.

Figure 7:
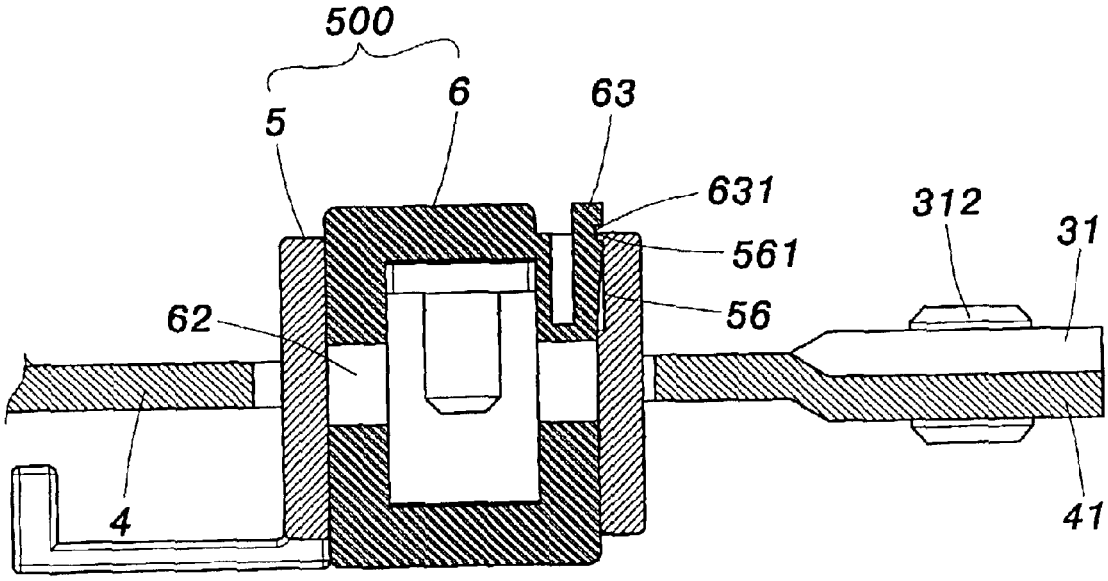
FIG. 7 is a regional section view of FIG. 5.

The mold unit 5 has an accommodating space 51 that communicates from top to bottom, having a side opening 53 allowing the slide block 7 to pass on the right side, on the left and right ends of the mold unit 5 are respectively a first cut 54 and a second cut 55; on the left end of the mold unit 5 is a joining hole 52, the joining hole 52 is penetrating through the first cut 54, so that the mold unit 5 is embedded fro the first cut 54 in a dented depressed groove 36 on a thicker side of the left handle 3, so the joining hole 52 is opposite to the joining hole 33 of the left handle, using a joining member 521 to penetrate the joining holes, so that the mold 5 is movably pivoted to the left handle 3, thereby the mold unit 5 can swing up and down. Besides, on an inside wall of the mold unit 5 is a formation of a second snap fastener 56 having a flange 561 (also shown in FIG. 7).

The mold body 6 is accommodated in the accommodating space 51, with its right end corresponding to a third cut 62 of the second cut 55, so that after the mold body 6 is accommodated in the accommodating space 51, the second and third cuts 55, 62 are overlapped on each other, and embedded in the thick side of the right handle 4. On the outside wall of the mold body 6 corresponding to the second snap fastener 56 is the formation of a first snap fastener 63 having a depressed groove 631 (also shown in FIG. 7), the first and the second snap fasteners 63, 56 can be fastened to each other, or separated from each other by an outside force, by this assembly including the first and second snap fasteners 63, 56 to achieve the purpose of replacing the mold body 6. The first snap fastener 63 is vertically joined to an erect post on a "side flange (shown in FIG. 7) of the mold body 6, its side near the top having a depressed groove 631 that can be fastened by the flange 561.

The slide block 7 has a joining post 71 that is suspended downward, the joining post 71 being joined inside the joining hole 43 of the right handle, to movably join the slide block 7 to the dented depression groove 45, so the slide block 7 has an up-and-down swinging function because of the connection, and a function for replacement at any time because it is movably connected. And, the slide block 7 is embedded in the mold body 6 from an inlet 61 of the mold body, thereby achieving the joining purpose of the joining pliers.

After the assembly and before the left and right handles 3, 4 are folded, the slide block 7 is penetrated in the side opening 53 of the mold unit5 and located in front of the inlet 61 of the mold body 6 (shown in FIG. 5), this is a status ready to be compressed and joined; when the left and right handles 3, 4 are folded, the slide block 7 slides deep in the inlet 61 of the mold body 6, meanwhile, the thick side of the right handle 4 is inserted into the second and third cuts 55, 62 (as in FIG. 6), this is a status after the compressing and joining process.

Figure 1:
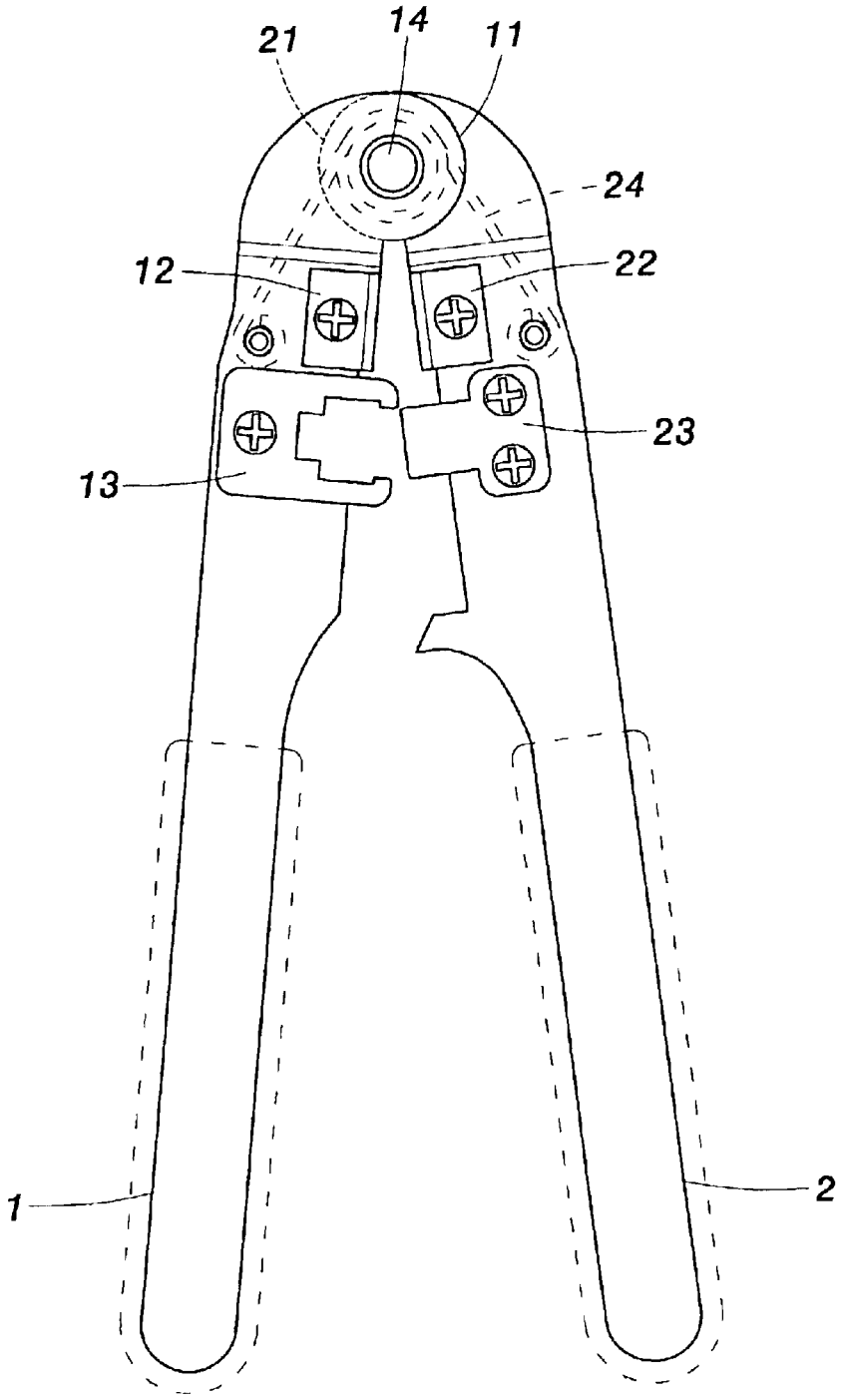
FIG. 1 PRIOR ART
FIG. 1 is a plan view of a prior art of joining pliers.
Figure 2:
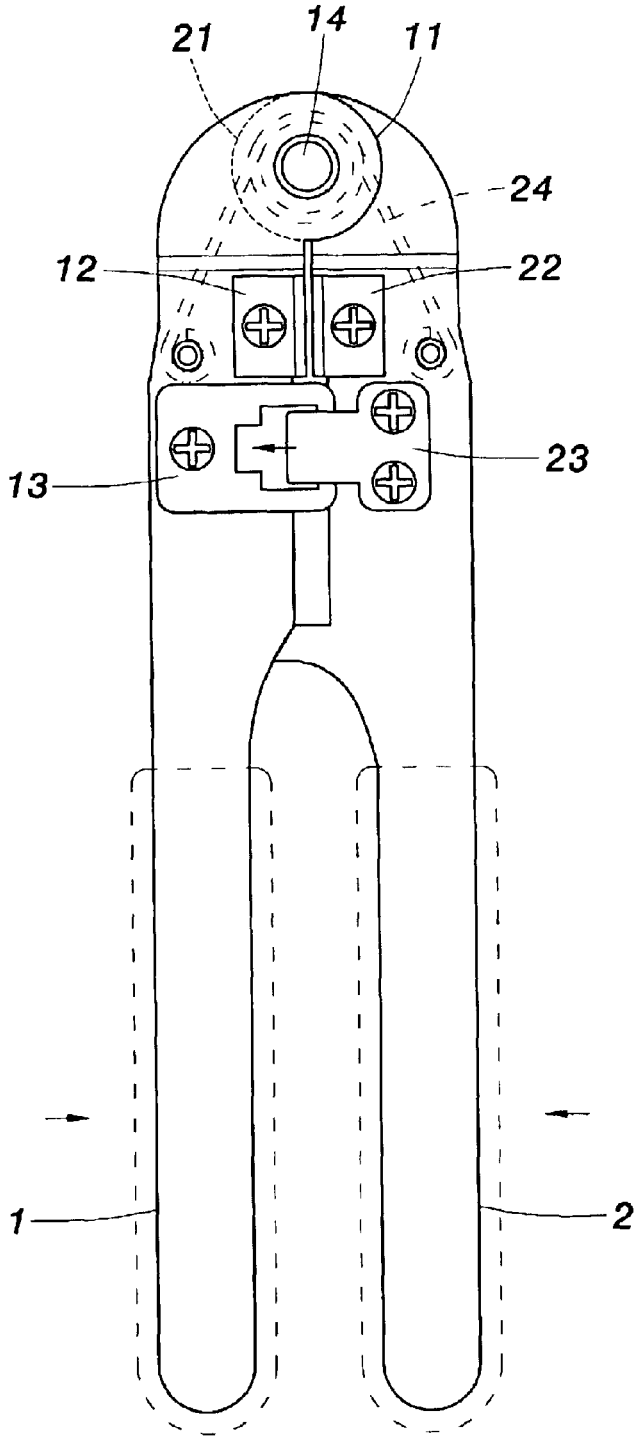
FIG. 2 PRIOR ART
FIG. 2 is a plan view of FIG. 1 when folded.
Figure 6:
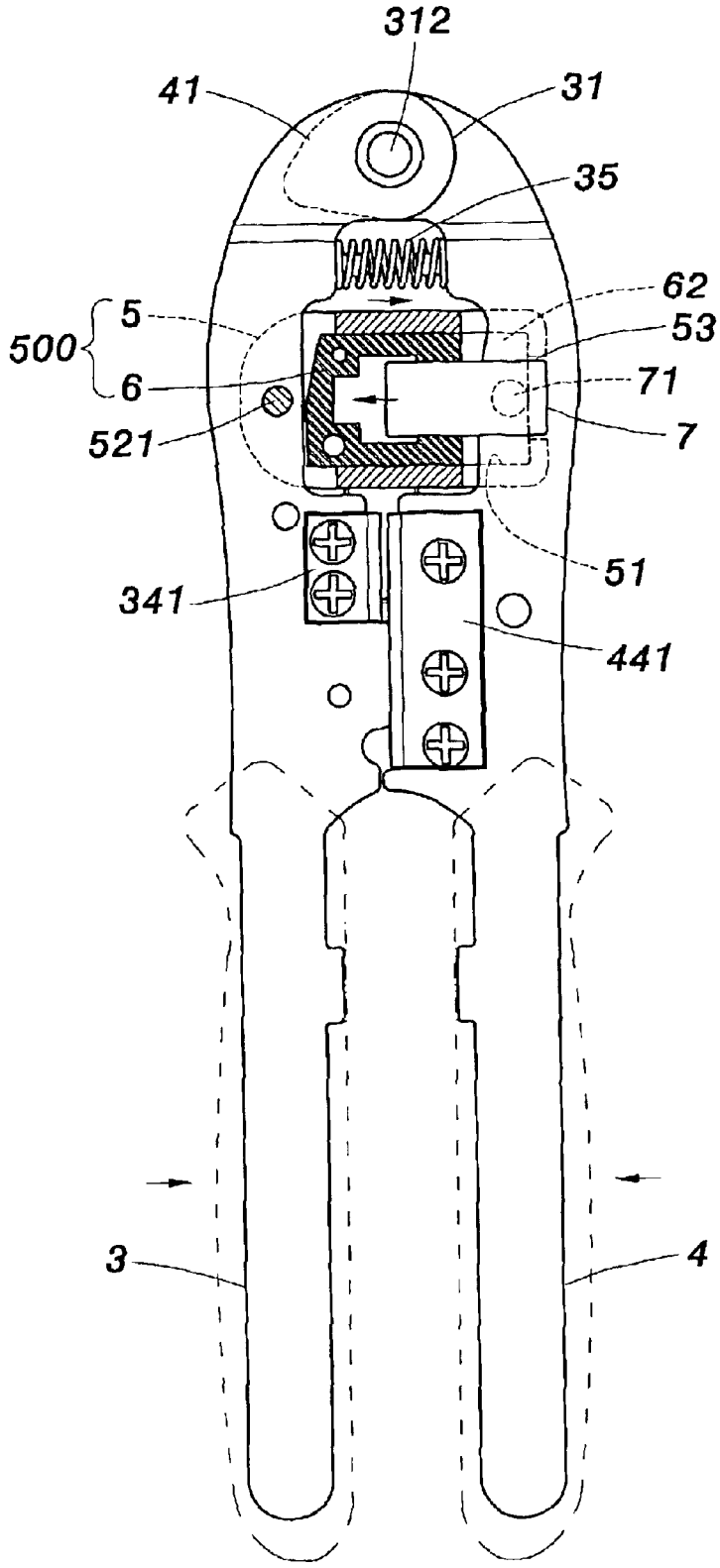
FIG. 6 is a plan view of the assembled invention, after operation.

In the construction of the present invention, as shown in FIGS. 5 and 6, when the user folds the left and right handles 3, 4, because the mold unit 5 and the slide block are movably pivoted and respectively pivoted to the left and right handles 3, 4, so during the process when the slide block 7 enters the inlet 61 of the mold body 6 (as in FIG. 3), it can be adjusted at any time automatically, so its moving line is not a conventional arch line, but a corrected straight line, so by the moving line of the straight line the embedding of the mold body 6 and the slide block 7 will not be deviated or deflected, relatively there will be no defect in the compressed joining effect on the pressed object by the joining pliers. Furthermore, please refer to FIGS. 1, 2 and 7, because the mold body 6 is so configured to be accommodated in the accommodating space 61 of the mold unit 5, using the first and second snap fasteners 63, 56 to fasten and separate them, and because the slide block 7 is so configured to be movably pivoted to the right handle 4, so it can be pulled out and disassembled at any time, therefore, the mold body 6 and the slide block 7 can be replaced to suit various types of object to be pressed, so in actual applications, there is no need to purchase a matching pair of joining pliers to suit the various types of objects to be pressed, thereby the user can significantly reduce purchase costs. Besides, please refer to FIG. 7, when the mold body 6 is accommodated in the accommodating space of the mold unit 5, the first snap fastener 63 is fastened by the second snap fastener 56 (the depressed groove 631 is fastened by the flange 561), to disassemble, the user needs only move the top end of the first snap fastener 63 to the left (the direction indicated in FIG. 7), then the first and second snap fasteners can be separated from each other, and by the separating of the mold body 6 from the mold unit 5, the purpose of replacement is achieved.

Of course, the two functions of the present invention (function one is the "mobility" to correct the moving line into a straight line of the mold body 6 and the slide block 7 when they are assembled, function two is the convenient "changeability" of the mold body 6 and the slide block 7 at any time to suit the various types of objects to be compressed and joined), it is not restricted to the preferred embodiment that requires simultaneously the functions of "mobility" and "changeability", if the joining pliers have only the "mobility" function, it can also be an embodiment of the present invention. Under the embodiment of the "mobility" function, the mold body 6 and the mold unit 5 are changed from separation to an opening mold 500 that is integrally assembled (not shown in drawing), please refer to FIGS. 5 and 6, the opening mold 500 can be a type that moves up and down, and the slide block can also be moving up and down, therefore, when the left and right handles 3, 4 are folded for the compressing and joining process, the moving line of the slide block 7 being embedded in the opening mold 500 can automatically correct the embedding position of the opening mold 700 and the slide block 7 at any time because of the up and down movement of the two components, so their moving line is in a straight line, and there will never be any deviation or defect in the compressing and joining process of the joining pliers.

In conclusion, the present invention provides an improved type of joining pliers that is capable of solving the shortcomings of deviation that are inevitable in conventional types because of they cannot be replaced and because of the arched moving line during the compressing and joining process, so the present invention has a high applicability and advanced performance, so this application is filed for a patent. Your favorable consideration shall be appreciated.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved set of joining pliers comprising:

a first handle;

a second handle pivotally coupled to the first handle, the first and second handles being pivotally displaceable one relative to the other between opened and closed positions;

an opening mold including a mold unit and a mold body, the mold unit being movably pivoted to the first handle, the mold body being inserted in the mold unit; and, a slide block movably pivoted to the second handle, said slide block being embedded in the opening mold for slidable displacement therein responsive to the relative pivotal displacement of the first and second handles between the opened and closed positions;

the opening mold and the slide block being thereby self-adjusted in relative linear alignment during the pivotal displacement of the first and second handles, the mold unit being accommodated in the mold body, the mold body and the slide block being replaceable when other types of objects are being compressed and pivoted;

wherein the mold unit and the mold body are engaged by an assembly structure therebetween, the assembly structure including first and second snap fasteners installed between the mold body and the mold unit, said first and second snap fasteners being fastened to each other and being separable from each other by an outside force.

2. An improved set of joining pliers comprising:

a first handle;

a second handle pivotally coupled to the first handle, the first and second handles being pivotally displaceable one relative to the other between opened and closed positions;

an opening mold including a mold unit and a mold body, the mold unit being coupled in pivotably displaceable manner to the first handle, the mold body being inserted in the mold unit; and, a slide block coupled in pivotally displaceable manner to the second handle, said slide block being embedded in the opening mold for slidable displacement therein responsive to the relative pivotal displacement of the first and second handles between the opened and closed positions;

the opening mold and the slide block being thereby self-adjusted in relative linear alignment during the pivotal displacement of the first and second handles, the mold body and the slide block being replaceable when other types of objects are being compressed and pivoted;

wherein the mold unit and the mold body are engaged by an assembly structure therebetween, the assembly structure having a second snap fastener on an inside wall of the mold unit, and a first snap fastener on a matching outside wall of the mold body to match the second snap fastener, the first and second fasteners being separable from each other by an outside force.

3. The improved joining pliers of claim 2, wherein the first snap fastener is shaped like a post and vertically pivoted to the mold body, on a side near a top of the first snap fastener being a depressed groove that is engaged for fastening purpose.

4. The improved joining pliers of claim 2, wherein the second snap fastener is a flange protruding from an inside wall of the mold unit.

* * * * *